US005362619A

United States Patent [19]

Tashiro et al.

[11] Patent Number: 5,362,619

[45] Date of Patent: Nov. 8, 1994

[54] HIGH-SPEED HALIDE PHOTOGRAPHIC LIGHT-SENSITIVE MATERIAL

[75] Inventors: Kouji Tashiro; Hiroyuki Hoshino; Shuji Murakami; Shoji Matsuzaka; Hirofumi Ohtani, all of Hino, Japan

[73] Assignee: Konica Corporation, Tokyo, Japan

[21] Appl. No.: 204,893

[22] Filed: Mar. 1, 1994

Related U.S. Application Data

[63] Continuation of Ser. No. 48,072, Apr. 15, 1993, abandoned, which is a continuation of Ser. No. 815,899, Dec. 31, 1991, abandoned, which is a continuation of Ser. No. 542,729, Jun. 22, 1990, abandoned.

[30] Foreign Application Priority Data

Jun. 27, 1989 [JP] Japan ..... 1-165080

[51] Int. Cl.[5] ..... G03C 1/015; G03C 1/035

[52] U.S. Cl. ..... 430/567; 430/568; 430/569; 430/605

[58] Field of Search ..... 430/567, 568, 569, 605

[56] References Cited

U.S. PATENT DOCUMENTS

| | | | |
|---|---|---|---|
| 4,184,878 | 1/1980 | Maternaghan | 430/567 |
| 4,497,895 | 2/1985 | Matsuzaka et al. | 430/569 |
| 4,684,607 | 8/1987 | Maskasky | 430/567 |
| 4,693,965 | 9/1987 | Ihama et al. | 430/569 |
| 4,705,747 | 11/1987 | Klötzer et al. | 430/550 |
| 4,722,884 | 2/1988 | Inoue et al. | 430/466 |
| 4,797,354 | 1/1989 | Saitou et al. | 430/567 |
| 4,798,775 | 1/1989 | Yagi et al. | 430/569 |
| 4,879,208 | 11/1989 | Urabe | 430/569 |
| 4,897,342 | 1/1990 | Kajiwara et al. | 430/569 |
| 5,017,469 | 5/1991 | Mowforth et al. | 430/569 |

FOREIGN PATENT DOCUMENTS

| | | | |
|---|---|---|---|
| 312999 | 4/1989 | European Pat. Off. | G03C 1/06 |
| 323215 | 7/1989 | European Pat. Off. | G03C 1/02 |

OTHER PUBLICATIONS

Patent Abstracts of Japan, vol. 12, No. 48 (P-666) (2895) Feb. 13, 1988; JPA-62-196644; Aug. 31, 1987.

*Primary Examiner*—Janet C. Baxter
*Attorney, Agent, or Firm*—Jordan B. Bierman

[57] ABSTRACT

A method for preparing a silver halide photographic emulsion containing silver halide grains , each of which has two or more phases different in the silver halide composition, comprising a step of growing silver halide grains, in which said silver halide grains are grown by supplying a solution of water-soluble silver salt and a solution of water-soluble halide, wherein fine grains of silver halide having a solubility product smaller than that of silver halide grains present in the course of growing silver halide grains are made present in the silver halide emulsion at a time during the grain-growth, iridium ions being individually added at a time when or after starting the grain-growth.

10 Claims, No Drawings

HIGH-SPEED HALIDE PHOTOGRAPHIC LIGHT-SENSITIVE MATERIAL

This application is a continuation of application Ser. No. 08/048,072, filed Apr. 15, 1993, now abandoned, which is a continuation of application Ser. No. 07/815,899, filed Dec. 31, 1991, now abandoned, which is a continuation of application Ser. No. 07/542,729, filed Jun. 22, 1990, now abandoned.

FIELD OF THE INVENTION

This invention relates to a silver halide photographic light-sensitive material and, particularly, to a method for preparing a silver halide photographic emulsion which is improved upon illuminance intensity reciprocity law failure and is high in sensitivity.

BACKGROUND OF THE INVENTION

In the field of silver halide photographic light-sensitive materials, there are demands for the light-sensitive materials which are improved upon reciprocity law failures such as a low intensity reciprocity law failure and a high intensity reciprocity law failure.

It has been known so far to add an iridium compound into a silver halide emulsion so as to improve such an illuminance intensity reciprocity law failure as mentioned above. For example, it is known that the illuminance intensity reciprocity law failure can be improved by adding an iridium compound to an emulsion during the growth of the crystal of the silver halide grains.

In the conventional techniques, however, a silver halide emulsion is desensitized or not so sensitized as to be expected even if an iridium compound is added to the silver halide emulsion, though the illuminance intensity reciprocity law failure may be improved. Therefore, these techniques do not answer to the demands for increasing the speed of light-sensitive materials.

SUMMARY OF THE INVENTION

It is an object of the invention to provide a silver halide photographic light-sensitive material in which the speed is made higher and the illuminance intensity reciprocity law failure is improved upon, by solving the problems of the above-described conventional techniques so that a high-speed sensitization and an illuminance intensity reciprocity law failure improvement can be made compatible, thereby satisfying not only the demand for restraining fog production but the demand for preventing any desensitization produced by a dye adsorption.

This invention relates to a method of preparing a silver halide photographic emulsion, which contains silver halide grains having different silver halide compositions mingled therein; wherein the grains are characterized in that the silver halide grains are grown in the presence of silver halide fine-grains having a solubility product smaller than that of the silver halide grains contained in the emulsion for at least one period in the course of growing the silver halide grains of the emulsion and iridium ions are made present at the time when or after starting the growth of the silver halide grains. (Such emulsion grains as described above is hereinafter sometimes referred to as 'the emulsion of the invention'.) The above described object of the invention can be achieved in the above-described constitution.

To be more concrete, when an iridium compound is added into the emulsions having been used conventionally so as to improve the illuminance intensity reciprocity law failure, a desensitization is thereby produced. On the other hand, when using such a specific silver halide emulsion as described above in the invention, the reciprocity law failure can be improved and a sensitization can further be attained in effects due to iridium ions present.

In addition to the above, according to the invention, a light-sensitive material having low fog level can be obtained and any desensitization produced by a dye adsorption can be prevented.

DETAILED DESCRIPTION OF THE INVENTION

First, the emulsion of the invention will be detailed.

The emulsion of the invention contains silver halide grains each having different compositions mingled together therein. The expression, of silver halide grains each having different compositions mingled together includes a case for example, where those grains each have one silver halide composition in the inner portion thereof and another different silver halide composition in the outer portion thereof. In the invention, it is permitted to mingle the silver halide compositions together in any embodiments.

In the emulsion of the invention, the silver halide grains thereof are grown up in at least one period in the course of growing the silver halide grains contained in the emulsion in the presence of the silver halide fine grains <hereinafter referred to as AgX grains (2), for convenience' sake> having a solubility product equivalent to or less than that of the silver halide grains contained in the emulsion <hereinafter referred to as AgX grains (1), for convenience' sake>.

The term, 'a solubility product', expressed in this patent specification are synonymous with that in the ordinary chemical expression.

As described above, AgX grains (1) are allowed to have two or more silver halide compositions in the grains. In the case where the different silver halide compositions are mingled in grains, the two or more kinds of silver halides mingled therein are allowed to be distributed in the grains either uniformly or ununiformly. In the invention, for example, the ununiform distributions such as those of the core/shell and epitaxial types are preferable and, among the types, the core/shell type is particularly preferable.

There is no special limitation to the silver halide compositions of AgX grains (1), and any AgX grains (1) may be used, provided the grains have phases different in silver halide compositions. Among these silver halides, silver iodobromide, silver chlorobromide and silver chloroiodobromide are preferable and, inter alia, silver iodobromide is particularly preferable. To be more concrete, for example, any ones such as mixedly crystallized silver iodobromide or silver chlorobromide can be used. It is, however, preferable to use silver iodobromide having a core/shell structure in which the cores each have a silver iodide content within the range of not less than 15 mol % to not more than 40 mol %.

The grain-sizes of AgX grains (1) are preferable to be not more than 3.0 μm in terms of a sphere-equivalent diameter.

AgX grains (1) may be either of the poly- and mono-disperse type and the mono-disperse type is more preferable.

The term, 'mono-disperse', expressed herein means that not less than 95% of all the grains have the grain-sizes within the range of ±40% of an average grain-size.

There is no special limitation to the grain configurations. For example, they may be in any configurations such as a cube, an octahedron, a tetradecahedron, a tabular-shape, a potato-shape, and so forth.

Emulsions of the invention containing the above-described AgX grains (1) can be used in at least one of the silver halide emulsion layers of a light-sensitive material and, in the case of two or more emulsion layers, it is preferable to use the emulsion of the invention in every emulsion layer.

Among all the silver halide grains contained in an emulsion layer, it is preferable that AgX grains (1) amount to at least not less than 30 mol% of all the grains and, particularly, to not less than 60 mol % thereof.

In the emulsion of the invention, AgX grains (1) are grown up under the presence of AgX grains (2), provided that AgX grains (2) having a solubility product smaller than those of AgX grains (1) are made present at least for a period in the course of growing AgX grains (1). In this case, AgX grains (2) may be so used as to grow up AgX grains (1), upon making AgX grains (2) present until a water-soluble halide solution and a water-soluble silver salt solution (hereinafter refered to as grain-growing elements) are completely supplied.

Generally, the average grain-sizes of AgX grains (2) are smaller than those of AgX grains (1). However, there may also be some instances where the average grain-sizes of AgX grains (2) are larger than those of AgX grains (1). The average grain-sizes of AgX grains (2) are within the range of, preferably, 0.001 to 0.7 μm, more preferably, 0.01 to 0.3 μm and, further preferably, 0.01 to 0.1 μm.

The embodiments of making AgX grains (2) present will be detailed and, at the same time, the processes of growing AgX grains (1) will also be explained below.

In the first method of growing AgX grains (1), seed silver halide grains are grown up by making use of both of a solution of water-soluble silver salts and a water-soluble halide solution which are the grain growing elements so that AgX grains (1) can be prepared. In the second method, silver halide nuclei are produced without making use of any seed grains but by making use of the above-described two the grain growing elements and the grains are then grown up so that AgX grains (1) can be prepared. From the viewpoint of the reproducibility of the grain-sizes of AgX grains (1), the first method may advantageously be used.

AgX grains (2) are required to make them present in a suspension system (hereinafter referred to as a mother liquor) in which AgX grains (1) are prepared, for at least one period of time in the course of growing AgX grains (1), or until the time at latest when AgX grains (1) are grown up completely.

In the case of using seed grains, AgX grains (2) may be made present in a mother liquor before making the seed grains present therein; and, AgX grains (2) may also be added into a mother liquor containing seed grains, prior to the addition of a grain growing element also, AgX grains (2) may be added into a mother liquor in the course of adding the grain growing elements; further, AgX grains (2) may be added separately two or more times selected from the above-described points of time of addition.

In the case of growing the grains after producing silver halide nuclei without using any seed grains, it is preferable to add AgX grains (2) after producing the nuclei. AgX grains (2) may be added before adding the grain growing elements or in the course of adding the elements, and further they may be added separately two or more times.

Also, AgX grains (2) and the grain growing elements may be added collectively, continuously or intermittently.

It is preferable to add AgX grains (2) and seed silver halide grains into a mother liquor with a multi-jet precipitation method such as a double-jet precipitation method, at an adding rate suitable for growing grains under the conditions where pH, pAg, temperatures and so forth are controlled.

AgX grains (2) and seed silver halide grains may be prepared in a mother liquor or may be added into the mother liquor after they are prepared outside the mother liquor.

As for the water-soluble silver salt solution applicable to prepare AgX grains (2), an ammoniacal silver salt solution may preferably be used.

As for the silver halide compositions of AgX grains (2), it is preferable to use silver iodide or silver iodobromide having a iodide content higher than that of silver iodobromide being grown, in the case, for example, that AgX grains (1) is silver iodobromide; and it is preferable to use silver bromide or silver chlorobromide having a bromide content higher than that of silver chlorobromide grains being grown, in the case, for example, that AgX grains (1) is silver chlorobromide. When AgX grains (1) is silver iodobromide, it is particularly preferable to use silver iodide as AgX grains (2).

In the case where AgX grains (1) is silver iodobromide or silver chloroiodobromide, it is preferable to supply all the iodide applicable for growing up grains so as to serve as AgX grains (2). It is, however, permitted to supply a part of the iodide in the form of an aqueous halide solution, provided, the effects of the invention may not be affected.

AgX grains (2) are preferable to be excellent in monodispersibility.

As for the compositions of seed silver halide grains, a variety of silver halides such as silver chloride, silver bromide, silver chlorobromide, silver chloroiodide, silver iodobromide, and silver chloroiodobromide may freely be used as desired.

In the preparation processes for the above-described AgX grains (1), the temperatures of the mother liquor are within the range of, preferably, 10° to 70° C. and, more preferably, 20° to 60° C.; and the pAg values thereof are within the range of, preferably, 6 to 11 and, more preferably, 7.5 to 10.5; and the pH values thereof are within the range of, preferably, 5 to 11 and, more preferably, 7 to 10.

The emulsions of the invention are those in which iridium ions are made present therein at least at the time when or after starting the growth of AgX grains (1).

The iridium ions may be made present by adding a water-soluble iridium salt.

There is no special limitation to the water-soluble iridium salts applicable to the invention, and they include, for example, $Na_3IrCl_6$, $K_3IrCl_6$, $K_2IrCl_6$, $(NH_4)_2IrCl_6$ and $Na_2IrCl_6$.

These compounds may also be used in any combination.

These iridium compounds may be used upon dissolving them in water or in a suitable solvent. As the common methods of stabilizing the iridium compound solution, it is allowed to use a method in which an aqueous hydrogen halide solution such as that of HCl, HBr or HF, or an alkali halide solution such as that of KCl, NaCl, KBr or NaBr is added into the iridium compound solution.

The iridium ions applicable to the invention may be added in an amount of, preferably, not more than $1\times10^{-4}$ mols per mol of the whole silver halide ultimately produced, more preferably, not more than $1\times10^{-5}$ mols and, further preferably, not more than $1\times10^{-7}$ mols.

Iridium ions may be made present at the time when or after starting the growth of grains. In other words, they are also allowed to be made present at the point of time when starting the growth of grains, in the course of growing them, or after grains are grown up. Iridium ions may be added in such a manner that the whole amount of the ions are added at any points of time when forming AgX grains (1), they are added separately several times, or they are added successively.

Iridium ions are also allowed to add in the mixture with an aqueous halide solution that is a silver halide grain growing element.

In this instance, it is preferable to add the iridium ions either at the time when or after 70% of the ultimate grain-size thereof are formed or prior to a chemical ripening treatment.

It may be considered that the positions in AgX grains (1) where iridium is contained may depend upon the various points of time when adding iridium ions in the course of growing grains. It is allowed that iridium may be contained in any positions of grains, namely, in the center thereof concentrically, on the surfaces thereof, or in all the portions thereof. It is particularly preferable that an iridium-containing layer is made present in about several hundreds Å from each of the grain surfaces. To be more concrete, it is most preferable to make iridium present in a layer about several hundreds Å apart from the surface of each grain. To make them present in this way, it will do that iridium is added immediately before completing the crystal grain growth and the grains are then grown for about several hundreds Å.

When preparing the emulsion of the invention or the other emulsions which are used in combination, if required, it is also permitted to add thereto a substance other than gelatin, such as those adsorptive to silver halide grains. As for the adsorptive substances, the compounds including, for example, a sensitizing dye, an antifoggant and a stabilizer which are commonly used in the art, or heavy metal ions may advantageously be used. The typical examples of these adsorptive substances are given in Japanese Patent Publication Open to Public Inspection (hereinafter referred to as Japanese Patent O.P.I. Publication) No. 62-7040/1987.

From the viewpoints of restraining fog production and improving the storage stability, it is preferable to add at least one kind each of the antifoggants and stabilizers selected from among the adsorptive substances when preparing a seed emulsion.

Among the antifoggants and stabilizers, heterocyclic mercapto compounds and/or azaindene compounds are particularly preferable to be used. More preferable examples of the heterocyclic mercapto compounds and azaindene compounds are detailed in, for example, Japanese Patent O.P.I. Publication No. 63-41848/1988 and they may be used in the invention.

The amounts of the above-described heterocyclic mercapto compounds and azaindene compounds to be added shall not be limitative. However, they may be added in an amount within the range of, preferably, $1\times10^{-5}$ to $3\times10^{-2}$ mols per mol of silver halides used and, more preferably, $5\times10^{-5}$ to $3\times10^{-3}$ mols. The above given amounts may suitably be selected according to the variations of the preparation conditions of silver halide grains, an average grain-sizes of silver halide grains and the kinds of the above-described compounds.

When an emulsion is completed to form silver halide grains, it is then desalted in a well-known method. As the desalting methods applicable thereto, a method described in Japanese Patent Application Nos. 62-81373/1987 and 63-9047/1988 may be used, in which a gelatin coagulant for desalting the grains serving as seed grains may be used; a noodle-washing method may also be used, in which gelatin is gelated to desalt an emulsion; and a coagulation methos may further be used, in which inorganic salts comprising a polyvalent anion, including, for example, sodium sulfate, an anionic surfactant and anionic polymers (such as polystyrene-sulfonic acid) are utilized.

Thus desalted silver halide grains are redispersed in gelatin, so that an emulsion may be prepared.

The emulsions applicable to the invention may be chemically sensitized in any ordinary methods including, namely, a sulfur sensitizing method in which a sulfur-containing compound capable of reacting with silver ions or active gelatin is used; a selenium sensitizing method in which a selenium compound is used; and a noble-metal sensitizing method in which a gold or other noble metal compound is used; independently or in combination.

As for the chemical sensitizers, chalcogens sensitizers, for example, may be used. Among them, a sulfur sensitizer and a selenium sensitizer are preferably used.

The sulfur sensitizers include, for example, a thiosulfate, allylthiocarbazide, thiourea, allylisothiocyanate, cystine, p-toluenethiosulfonate and rhodanine. Besides the above, the sulfur sensitizers described in U.S. Pat. Nos. 1,574,944, 2,410,689, 2,278,947, 2,728,668, 3,501,313 and 3,656,955, West German (OLS) Patent No. 1,422,869, and Japanese Patent O.P.I. Publication Nos. 56-24937/1981 and 55-45016/1980 each may be used.

The amounts of the sulfur sensitizer to be added are varied to a considerable extent according to the various conditions such as pH values, temperatures and the sizes of silver halide grains. As a rough standard, an amount thereof to be added is preferably within the extent of the order of $10^{-7}$ to $10^{-1}$ mols per mol of silver halides used.

The selenium sensitizers applicable thereto include, for example, aliphatic isoselenocyanates such as allylisoselenocyanate, selenoureas, selenoketones, selenoamides, selenocarboxylates and the esters thereof, selenophosphates, and selenides such as diethylselenide and diethyldiselenide. The typical examples thereof are given in U.S. Pat. Nos. 1,574,944, 1,602,592 and 1,623,499.

Also, a reduction sensitizer may be used in combination. The reduction sensitizers include, for example, stannous chloride, thiourea dioxide, hydrazine and polyazine.

Further, the noble-metal compounds other than those of gold, such as a palladium compound, may be used in combination.

In the invention, it is preferable that AgX grains (1) contain a gold compound. The gold compounds preferably applicable to the invention include, for example, various kinds of gold compounds which may have the oxidation number of either +1 or +3 valency. The typical examples thereof include a chloroaurate, potassium chloroaurate, auric trichloride, potassium auric thiocyanate, potassium iodoaurate, tetracyanoauric azide, ammonium aurothiocyanate, pyridyl trichlorogold, gold sulfide and gold selenide.

The gold compounds may be so used as not only to sensitize grains, but not to substantially contribute to any sensitization.

The amounts of the gold compounds to be added are varied according to the various requirements. As a rough standard, they are added in an amount within the range of $10^{-8}$ to $10^{-1}$ mols per mol of silver halides used and, preferably, $10^{-7}$ to $10^{-2}$ mols. These compounds may be added at any points of time when forming AgX grains, when physically or chemically ripening, and when completing the chemical ripening treatment.

The emulsions may be spectrally sensitized to any desired wavelength regions by making use of sensitizing dyes. The sensitizing dyes are allowed to use either independently or in combination.

It is also allowed to contain, together with the sensitizing dyes, a supersensitizer for enhancing the sensitizing functions of the sensitizer, that is, a dye having no spectrally sensitizing function in itself or a compound incapable of substantially absorbing any visible rays of light.

The silver halide photographic light-sensitive materials relating to the invention can be used for any light-sensitive materials including, for example, black-and-white silver halide photographic light-sensitive materials (such as an X-ray or lithographic light-sensitive materials and black-and-white photographing negative films), and color photographic light-sensitive materials (such as color negative films, color reversal films and color print papers).

They may further be used for diffusion-transfer type light-sensitive materials (such as color diffusion-transfer elements and silver salt diffusion-transfer elements), and thermal-development type light-sensitive materials (such as those for black-and-white or color use).

In the case of multicolor photographic light-sensitive materials, they are each comprised of a support multilayered thereonto with the suitable numbers of blue-, green- and red-sensitive AgX emulsion layers in suitable order which contain usually yellow, magenta and cyan couplers, respetively, as the photographic couplers and, if required, with the suitable numbers of non-light-sensitive layers so that a color reproduction may be performed in a substractive color process. The numbers of the layers and the multilaying order thereof may suitably be changed to meet the priority characteristics and the purpose of application.

The photographic light-sensitive materials of the invention are permitted to use therein any desirable additives including, for example, an antifoggant, a hardener, a plasticizer, a latex, a surfactant, an antistain agent, a matting agent, a lubricant and an antistatic agent.

The photographic light-sensitive materials of the invention may be subjected to a variety of black-and-white or color developing treatments so that images may be formed.

The color developing agents applicable to the color developing treatmented are allowed to use the derivatives of the aminophenol and p-phenylenediamine types, which are widely used in a variety of color photographic processes.

The color developers applicable to treat the photographic light-sensitive materials are allowed to contain the known compounds for the components of the developers, as well as an aromatic primary amine type color developing agent. Such treatments may also be performed in a system in which any benzyl alcohol having the problem of pollution load is not contained.

The pH values of such a developer as mentioned above are usually not less than 7 and, most generally, within the range of about 10 to 13.

The color developing temperatures are usually not lower than 15° C. and, more usually, within the range of 20° to 50° C. It is preferable to develop at a temperature of not lower than 30° C. in a rapid developing treatment. Meanwhile, it takes 3 to 4 minutes to perform a conventional treatment. However, when using an emulsion prepared for a rapid treatment, the color developing time may be generally saved to be 20 to 60 seconds and, further, within 30 to 50 seconds.

In the case of color-developing the photographic light-sensitive materials of the invention, a bleaching treatment and a fixing treatments are carried out, generally, after they are color developed. The bleaching and fixing treatments are also allowed to perform at the same time.

Usually, a washing treatment follows after the fixing treatment. A stabilizing treatment may be made in place of the washing treatment, or the both treatments may be made together.

[EXAMPLES]

Next, the invention will be detailed with reference to the examples given below. It is, however, the matter of course that the invention shall not be limited to the following examples.

First, the preparation of each emulsion applicable to the examples will now be detailed.

Preparation of Seed Emulsion N-1 Preparation Example 1)

According to the procedures detailed in Japanese Patent O.P.I. Publication No. 50-45437/1975, 250 ml of an aqueous solution of 4M-$AgNO_3$ (in which M represents molarity) and 250 ml of 4M-KBr-KI solution having a ratio of KBr:KI=98:2 (mol ratio) were each added into 500 ml of an aqueous 2.0% gelatin solution warmed up to 40° C., over a period for 35 minutes while controlling the pAg to be 9.0 and pH to be 2.0, in a controlled double-jet precipitation. The aqueous gelatin solution of thus obtained silver halide grains containing the whole amount of silver added was adjusted to be pH 5.5 with the use of an aqueous potassium carbonate solution. Thereto, 64 ml of an aqueous solution of 5% Demol N, manufactured by Kao-Atlas Company, as a precipitant and 244 ml of an aqueous 20% magnesium sulfate solution as polyvalent ions were then added so as to produce a coagulation. The resulting coagulation were precipitated by allowing them to stand and the supernatant liquid was then decanted. Further, 1,400 ml of distilled water were added and dispersed again. The resulting redispersion was again coagulated and precipitated by adding 36.4 ml of an aqueous 20% magnesium sulfate solution and the resulting supernatant liquid was decanted. The whole amount was made to be 425 ml by adding an aqueous solution containing 28 g of ossein gelatin, and the resulting solution was dispersed at 40° C. for 40 minutes, so that a seed emulsion was prepared.

The resulting emulsion was named N-1. As the results of the electron-microscopic observations, N-1 was proved to be a monodisperse type emulsion having an average grain-size of 0,093 μm.

Preparation of Seed Emulsion N-2 (Preparation Example 2)

In the same way as in Preparation Example 1, AgBrI seed emulsion N-1 having an average grain-size of 0.27 μm and a silver iodide content of 2 mol % was prepared.

Manufacturing Example 1 of Emulsion

By making use of the following 6 kinds of solutions, 4 kinds of emulsions, EM-1 through EM-4, were prepared. In Emulsion EM-1, the grains thereof were of the core/shell type silver iodobromide having an average grain-size of 0.38 μm and an average AgI content of 8.46 mol %.

| | |
|---|---|
| (Solution A-1) | |
| Ossein gelatin | 28.78 g |
| $HO(CH_2CH_2O)_m(CH(CH_3)CH_2O)_p(CH_2CH_2O)_nH$ | |
| A aqueous 10% ethanol solution containing Pronon manufactured by Nippon Yusi Company, having an average molecular weight of 1700 | 16.5 ml |
| KI | 146.5 g |
| Distilled water | 5287 ml |
| (Solution B-1) | |
| Seed Emulsion N-1 | An amount equivalent to 0.1552 mols of AgX |
| 4-hydroxy-6-methyl-1,3,3a,7-tetrazaindene, (hereinafter called TAI) | 247.5 mg |
| An aqueous 56% acetic acid solution | 72.6 ml |
| An aqueous 28% ammonia | 97.2 ml |
| Add distilled water to make | 1020 ml |
| (Solution C-1) | |
| $AgNO_3$ | 1774 g |
| An aqueous 28% ammonia | 1447 ml |
| Add distilled water to make | 2983 ml |
| (Solution D-1) | |
| Ossein gelatin | 50 g |
| KBr | 2082.5 g |
| TAI | 2.535 g |
| Add distilled water to make | 5000 ml |
| (Solution E-1) | |
| An aqueous 20% KBr solution | An amount required for adjusting pAg |
| (Solution F-1) | |
| An aqueous 56% acetic acid solution | An amount required for adjusting pH |

By making use of a mixing stirrer appeared in Japanese Patent O.P.I. Publication Nos. 57-92523/1082 and 57-92524/1982, 252 ml of Solution C-1 was added into Solution A-1 by taking one minute at 40° C. so as to produce AgI grains. As the results obtained through the electron-microscopic observation, the resulting AgI grains were proved to have an average grain-size of about 0.05 μm. The AgI grains corresponded to the silver halide fine grains <the foregoing AgX (2)>embodied in this Example. Following after the production of the AgI grains, Solution B-1 was added thereinto.

Next, Solutions C-1 and D-1 were added with a double jet precipitation method while controlling the pAg, pH of the mixture and the flow rates of Solutions C-1 and D-1, as shown in Table-1. When making a double jet precipitation of Solutions C-1 and D-1 only, silver bromide was produced. However, as the result from the growth of the grains in the presence of the AgI grains, silver iodobromide was grown up, because AgI grains had already been made present at this stage. When AgI grains were consumed by keeping the additions of the both solutions on, silver bromide was produced successively. Therefore, the resulting grains each had the silver halide compositions different from each other, that is, they were comprised of silver iodobromide to serve as the cores thereof and silver bromide as the shells.

In the course of the double jet precipitation, the pAg and pH were adjusted by the flow rates of Solutions E-1 and F-1 by means of a variable flow-rate roller tube pump. Two minutes after completing the addition of Solution C-1, the pAg was adjusted to be 10.4 with Solution E-1 and then two minutes after, the pH was adjusted to be 6.0 with Solution F-1.

Next, a desalting and washing treatments were carried out in ordinary methods and a dispersion was then carried out in an aqueous solution containing 197.4 g of ossein gelatin. After then, the whole amount was adjusted to be 3000 ml with distilled water, so that Emulsion EM-1 was obtained.

Emulsions EM-2 through EM-4 were prepared in the procedures described below.

EM-2 was prepared in the procedures that the grains were grown up in quite the same manner as in EM-1 and silver was added in an amount of 98.5% of the whole amount of silver to be added until the crystal growth is to be completed and, at the point where the silver was so added, $K_2IrCl_6$ was added in an amount of $6.5\times10^{-6}$ mols per mol of AgX.

EM-3 was prepared in the procedures that the grains were grown up in quite the same manner as in EM-2 and silver was added in an amount of 98.5% of the whole amount of silver to be added until the crystal growth is to be completed and, at the point where the silver was so added, $K_2IrCl_6$ was added in an amount of $6.5\times10^{-8}$ mols per mol of AgX.

EM-4 was prepared in the procedures that the grains were grown up in quite the same manner as in EM-3 and silver was added in an amount of 90.0% of the whole amount of silver to be added until the crystal growth is to be completed and, at the point where the silver was so added, $K_2IrCl_6$ was added in an amount of $6.5\times10^{-8}$ mols per mol of AgX.

TABLE 1

| Grain Growth Conditions (EM-1) | | | | |
|---|---|---|---|---|
| Time | | | Rate of Addition (ml/min.) | |
| (min.) | pAg | pH | Solution C-1 | Solution D-1 |
| 0 | 8.55 | 9.00 | 9.8 | 9.3 |
| 7.85 | 8.55 | 8.81 | 30.7 | 29.2 |
| 11.80 | 8.55 | 8.60 | 44.9 | 42.7 |
| 17.33 | 8.55 | 8.25 | 61.4 | 58.4 |
| 19.23 | 8.55 | 8.10 | 63.5 | 60.4 |
| 22.19 | 8.55 | 7.88 | 56.6 | 53.8 |
| 28.33 | 8.55 | 7.50 | 41.2 | 39.8 |
| 36.61 | 9.38 | 7.50 | 31.9 | 34.1 |
| 40.44 | 9.71 | 7.50 | 30.6 | 37.1 |
| 45.14 | 10.12 | 7.50 | 34.6 | 57.8 |
| 45.97 | 10.20 | 7.50 | 37.3 | 36.3 |
| 57.61 | 10.20 | 7.50 | 57.3 | 55.8 |
| 63.08 | 10.20 | 7.50 | 75.1 | 73.1 |

TABLE 1-continued

| Time (min.) | Grain Growth Conditions (EM-1) pAg | pH | Rate of Addition (ml/min.) Solution C-1 | Solution D-1 |
|---|---|---|---|---|
| 66.63 | 10.20 | 7.50 | 94.0 | 91.4 |

Manufacturing Example 2 of Emulsions (Comparative Emulsion)

A core/shell type silver iodobromide emulsion was so prepared as to have the AgI contents of 15 mol %, 5 mol % and 3 mol % in order from the inside of the grains, an average grain-size of 0.38 μm and an average AgI content of 8.46 mol %, by making use of the 7 kinds of solutions given below. Each part inside the grain had a different silver iodide content and aqueous gelatin solutions were used in every part of the grains. The emulsion could therefore be used for the purpose of the comparison.

| | |
|---|---|
| (Solution A-5) | |
| Ossein gelatin | 28.6 g |
| Pronon, a 10% ethanol solution | 16.5 ml |
| TAI | 247.5 mg |
| An aqueous 56% acetic acid solution | 72.6 ml |
| A 28% aqueous ammonia | 97.2 ml |
| Seed Emulsion N-1 | An amount equivalent to 0.1552 mols of AgX |
| Add distilled water to make | 6600 ml |
| (Solution B-5) | |
| Ossein gelatin | 13 g |
| KBr | 460.2 g |
| KI | 113.3 g |
| TAI | 665 mg |
| Add distilled water to make | 1300 ml |
| (Solution C-5) | |
| Ossein gelatin | 17 g |
| KBr | 672.6 g |
| KI | 49.39 g |
| TAI | 870 mg |
| Add distilled water to make | 1700 ml |
| (Solution D-5) | |
| Ossein gelatin | 8 g |
| KBr | 323.2 g |
| KI | 13.94 g |
| TAI | 409 mg |
| Add distilled water to make | 800 ml |
| (Solution E-5) | |
| $AgNO_3$ | 1773.6 g |
| A 28% aqueous ammonia | 1470 ml |
| Add distilled water to make | 2983 ml |
| (Solution F-5) | |
| An aqueous 20% KBr solution | An amount required for adjusting pAg |
| (Solution G-5) | |
| An aqueous 56% acetic acid solution | An amount required for adjusting pH |

By making use of the same mixing stirrer as used in Manufacturing Example 1 at a temperature of 40° C., Solutions E-5 and B-5 were added into Solution A-5 with the double jet precipitation method. At the same time when completing the addition of B-5, C-5 was added and, at the same time when completing the addition of C-5, D-5 was added. In the course of the double jet precipitation, the controls of the pAg and pH values and the adding rates of Solutions E-5, B-5, C-5 and D-5 are each shown in Table-2.

The pAg and pH values were controlled by changing the flow-rates of Solutions F-5 and G-5 by means of a variable flow-rate roller tube pump.

After completing the addition of Solution E-5, the adjustments of pAg and pH, the desalting and washing treatments and the dispersing treatments were carried out in the same manner as in Manufacturing Example 1.

The resulting emulsion is called EM-5.

TABLE 2

| Time (min.) | Grain Growth Conditions (EM-5) pAg | pH | Rate of Addition of Solution (ml/min.) Solution E-5 | Solution B-5 | Solution C-5 | Solution D-5 |
|---|---|---|---|---|---|---|
| 0 | 9.00 | 8.55 | 9.8 | 9.3 | | |
| 7.85 | 8.81 | 8.55 | 30.7 | 29.2 | | |
| 11.80 | 8.63 | 8.55 | 44.9 | 42.7 | | |
| 17.33 | 8.25 | 8.55 | 61.4 | 58.4 | | |
| 19.23 | 8.10 | 8.55 | 63.5 | 60.4 | | |
| 22.19 | 7.88 | 8.55 | 56.6 | 53.8 | | |
| 28.33 | 7.50 | 8.55 | 41.2 | 39.8 | 39.8 | |
| 36.61 | 7.50 | 9.38 | 31.9 | | 34.1 | |
| 40.44 | 7.50 | 9.71 | 30.6 | | 37.1 | |
| 45.14 | 7.50 | 10.12 | 34.6 | | 57.8 | |
| 45.97 | 7.50 | 10.20 | 37.3 | | 36.3 | |
| 57.61 | 7.50 | 10.20 | 57.3 | | 55.8 | 55.8 |
| 63.08 | 7.50 | 10.20 | 75.1 | | | 73.1 |
| 66.63 | 7.50 | 10.20 | 94.0 | | | 91.4 |

Further, Emulsion EM-6 was prepared in the following procedures. EM-6 was prepared in the manner that grains were grown up under quite the same conditions as in EM-5 and then by adding $K_2IrCl_6$ in an amount of $6.5\times10^{-8}$ mols per mol of AgX when an amount of 98.5% of the whole silver was added.

Manufacturing Example 3 of Emulsion

In the same procedures as in Manufacturing Example 1, AgX grains (those of the core/shell type AgBrI) were so prepared as to have an average grain-size of 0.65 μm and an average AgI content of 7.16 mol %.

| | |
|---|---|
| (Solution A-3) | |
| Ossein gelatin | 45 g |
| KI | 116.8 g |
| Pronon, a 10% ethanol solution | 30 ml |
| Add distilled water to make | 9191 ml |
| (Solution B-3) | |
| Seed Emulsion N-2 | An amount equivalent to 0.759 mols of AgX |
| An aqueous 56% acetic acid solution | 112.5 ml |
| A 28% aqueous ammonia | 175.5 ml |
| TAI | 600 mg |
| Add distilled water to make | 2608 ml |
| (Solution C-3) | |
| $AgNO_3$ | 1671 g |
| A 28% aqueous ammonia | 1363 ml |
| Add distilled water to make | 2810 ml |
| (Solution D-3) | |
| Ossein gelatin | 50 g |
| KBr | 2082.5 g |
| TAI | 5.338 g |
| Add distilled water to make | 5000 ml |
| (Solution E-3) | |
| The same as in Solution E-1 | |
| (Solution F-3) | |
| The same as in Solution F-1 | |

The preparation was carried out in the same procedures as in Manufacturing Example 1, except that 201 ml of Solution C-3 was added into Solution A-3 by taking one minute at a temperature of 40° C. The pAg, pH and flow-rate thereof are shown in Table-3. The resulting emulsion is called EM-7. The grains contained in this emulsion were mixedly comprised of silver iodobromide in the cores thereof and silver bromide in the shells thereof.

TABLE 3

| Time (min.) | Grain Growth Conditions (EM-7) pAg | pH | Rate of Addition (ml/min.) Solution C-3 | Solution D-1 |
|---|---|---|---|---|
| 0 | 9.00 | 8.55 | 22.1 | 22.1 |
| 7.01 | 8.93 | 8.55 | 18.8 | 18.8 |
| 18.45 | 8.77 | 8.55 | 30.4 | 30.4 |
| 30.22 | 8.55 | 8.55 | 41.5 | 41.5 |
| 33.98 | 8.46 | 8.55 | 51.5 | 51.5 |
| 35.92 | 8.40 | 8.55 | 65.7 | 67.6 |
| 38.19 | 8.31 | 9.04 | 77.4 | 84.3 |
| 39.60 | 8.25 | 9.38 | 83.7 | 97.2 |
| 41.64 | 8.18 | 9.79 | 55.8 | 82.7 |
| 44.07 | 8.11 | 10.12 | 38.7 | 79.5 |
| 44.83 | 8.10 | 10.20 | 35.6 | 36.4 |
| 61.76 | 7.80 | 10.20 | 30.4 | 31.1 |
| 82.4 | 7.50 | 10.20 | 24.5 | 25.1 |

The resulting grains were grown up under quite the same conditions as in EM-7 and then by adding $K_2IrCl_6$ in an amount of $6.5\times10^{-8}$ mols per mol of AgX when an amount of 98.5 of the whole silver was added. The resulting emulsion is called EM-8.

Manufacturing Example 4 of Emulsions (Comparative Emulsion)

With reference to Manufacturing Example 2, a silver iodobromide emulsion (for comparative use) was so prepared as to have the AgI contents of 15 mol %, 5 mol % and 3 mol % in order from the inside of the grains thereof, an average grain-size of 0.65 μm and an average AgI content of 7.16 mol %. The resulting emulsion is hereinafter called EM-9.

Further, another emulsion was prepared by growing the grains thereof in quite the same manner as in EM-9 and by adding $K_2IrCl_6$ in an amount of $6.5\times10^{-8}$ mols per mol of AgX at which 98.5% of the whole silver to be added. The resulting emulsion is hereinafter called EM-10.

Manufacturing Example 5 of Emulsions (Comparative Emulsion)

With reference to Manufacturing Example 4, an octahedral monodisperse type emulsion, EM-11, for comparative use was so prepared as to have a silver iodide content of 2 mol % and an average grain-size of 0.65 μm.

Further, another emulsion was prepared by growing the grains thereof in quite the same manner as in EM-11 and by adding $K_2IrCl_6$ in an amount of $6.5\times10^{-8}$ mols per mol of AgX at which 98.5% of the whole silver to be added. The resulting emulsion is hereinafter called EM-12.

EXAMPLE 1

Each of EM-1 through EM-6 described in Manufacturing Examples 1 and 2 was subjected to an optimum gold-sulfur sensitization, so that six kinds of chemically sensitized emulsions were obtained. Using the two kinds of emulsions, EM-1 and -5, separate from the above emulsions, two kinds of emulsion were obtained of EM-1 by adding $K_2IrCl_6$ in an amount of $6.5\times10^{-6}$ mols per mol of AgX and $K_2IrCl_6$ in an amount of $6.5\times10^{-8}$ mols per mol of AgX, respectively, and the other two kinds of emulsion were obtained of EM-5 in the same manner.

The resulting emulsions were ripened for 30 minutes and then subjected to gold-sulfur sensitizations, respectively, so that four kinds in total of sensitized emulsions were obtained. Each of these emulsions was spectrally sensitized to blue rays of light by adding the following Sensitizing Dyes (I) and (II) in an amount of 350 mg per mol of AgI, respectively.

Next, the emulsions were each stabilized by adding TAI and 1-phenyl-5-mercaptotetrazole. To each of the resulting 10 kinds of emulsions, the photographic additives such as a spreading agent and a layer hardener so as to prepare the coating solutions. The coating solutions were coated over to the sublayered film bases and were then dried up in an ordinary method, respectively, so that Samples No. 1 through No. 10 were prepared.

Further, the yellow coupler (Y-1) was dissolved in ethyl acetate and dioctyl phthalate in an amount by weight equivalent to that of the coupler. The resulting solution was emulsified by dispersing it and, after adding it into each of the emulsions, the resulting coating solutions were coated and dried in the same manner as in Sample No. 1 through No. 10, so that Sample No. 11 through No. 20, respectively.

Sensitizing dye (I)

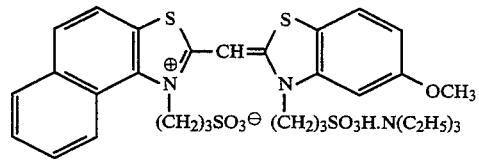

Sensitizing dye II

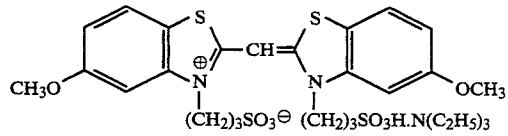

Y-i

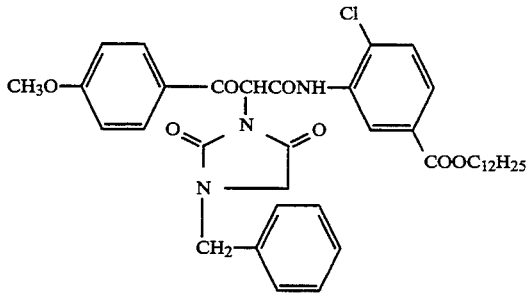

Each of Sample No. 1 through No. 20 was exposed to light through an wedge by using a blue filter under the 3 kinds of exposure conditions of 8 seconds, 1/12.5 seconds and $1\times10^{-4}$ seconds. Among the samples already exposed to light, Sample No. 1 through No. 10 were treated in a 90-second process with the following processing solutions in the processing steps (i) given below by making use of a KX-500 automatic processor manufactured by Konica Corp, thereby determining the photographic sensitivities of the processed samples.

| Processing steps (I) (35° C.) | |
|---|---|
| Developing | 25 seconds |

-continued

| Processing steps (I) (35° C.) | |
|---|---|
| Fixing | 25 seconds |
| Washing | 25 seconds |
| Drying | 15 seconds |

The composition of each processing solution used in the above processing steps will be given below:

| | |
|---|---|
| <Developer> | |
| Potassium sulfite | 55.0 g |
| Hydroquinone | 25.0 g |
| 1-phenyl-3-pyrazolidone | 1.2 g |
| Boric acid | 10.0 g |
| Sodium hydroxide | 21.0 g |
| Triethylene glycol | 17.5 g |
| 5-methylbenzotriazole | 0.06 g |
| 5-nitroindazole | 0.14 g |
| 1-phenyl-5-mercaptotetrazole | 0.015 g |
| Glutaraldehyde bisulfite | 15.0 g |
| Glacial acetic acid | 16..0 g |
| Potassium bromide | 4.0 g |
| Triethylenetetraminehexaacetate | 2.5 g |
| Add water to make | 1 liter |
| Adjust pH to be pH = 10.20 | |
| <Fixer> | |
| Disodium ethylenediaminetetraacetate | 5.0 g |
| Tartaric acid | 3.0 g |
| Ammonium thiosulfate | 130.9 g |
| Sodium sulfite, anhydrous | 7.3 g |
| Boric acid | 7.0 g |
| Acetic acid, in a 90 wt % solution | 5.5 g |
| Sodium acetate, 3-hydroxide | 25.8 g |
| Aluminium sulfate, 18-hydroxide | 14.6 g |
| Sulfuric acid, in a 50 wt % solution | 6.77 g |
| Add water to make | 1 liter |
| Adjust pH to be pH = 4.20 | |

Sample No. 11 through No. 20 were exposed to light in the same way as in Sample No. 1 through No. 10 and were then treated in the processing steps (II) given below:

| Processing steps (II) (38° C.) | |
|---|---|
| Color developing | 3 min. 15 sec. |
| Bleaching | 6 min. 30 sec. |
| Washing | 3 min. 15 sec. |

-continued

| Processing steps (II) (38° C.) | |
|---|---|
| Fixing | 6 min. 30 sec. |
| Washing | 3 min. 15 sec. |
| Stabilizing | 1 min. 30 sec. |
| Drying | |

The composition of each processing solution used in the above processing steps will be given below:

| | |
|---|---|
| <Color developer> | |
| 4-amino-3-methyl-N-ethyl-N-(β-hydroxyethyl)-aniline sulfate | 4.75 g |
| Sodium sulfite, anhydrous | 4.25 g |
| Hydroxylamine ½ sulfate | 2.0 g |
| Potassium carbonate, anhydrous | 37.5 g |
| Potassium bromide | 1.3 g |
| Trisodium nitrilotriacetate (monohydrate) | 2.5 g |
| Potassium hydroxide | 1.0 g |
| Add water to make | 1 liter |
| <Bleaching solution> | |
| Iron ammonium ethylenediaminetetraacetate | 100.0 g |
| Diammonium ethylenediaminetetraacetate | 10.0 g |
| Potassium bromide | 150.0 g |
| Glacial acetic acid | 10.0 g |
| Add water to make | 1 liter |
| Adjust pH with aqueous ammonia to be pH = 6.0 | |
| <Fixer> | |
| Ammonium thiosulfate | 175.0 g |
| Ammonium sulfite, anhydrous | 8.6 g |
| Sodium metasulfite | 2.3 g |
| Add water to make | 1 liter |
| Adjust pH with acetic acid to be pH = 6.0 | |
| <Stabilizer> | |
| Formalin (in a 37% solution) | 1.5 ml |
| Konidux (manufactured by Konica Corp.) | 7.5 ml |
| Add water to make | 1 liter |

Table-4 shows the results of fog (Dmin) and the sensitivities obtained by exposing each sample to light.

TABLE 4

| No. | Emulsion | Ir content of surface (mol/molAgX) | Dmin | Sensitivity 8-sec. exposure | 1/12.5-sec. exposure | $1 \times 10^{-4}$-sec. exposure | Distinction between Invention and Out of Invention |
|---|---|---|---|---|---|---|---|
| 1 | EM-1 | — | 0.19 | 80 | 100 | 80 | Out of Invention* |
| 2 | EM-2 | — | 0.15 | 135 | 150 | 145 | Invention* |
| 3 | EM-3 | — | 0.16 | 210 | 250 | 230 | Invention* |
| 4 | EM-4 | — | 0.15 | 135 | 165 | 155 | Invention* |
| 5 | EM-5 | — | 0.20 | 65 | 80 | 65 | Out of Invention |
| 6 | EM-6 | — | 0.19 | 40 | 50 | 45 | Out of Invention |
| 7 | EM-1 | $6.5 \times 10^{-6}$ | 0.16 | 140 | 160 | 150 | Invention* |
| 8 | EM-1 | $6.5 \times 10^{-8}$ | 0.16 | 195 | 230 | 215 | Invention* |
| 9 | EM-5 | $6.5 \times 10^{-6}$ | 0.18 | 35 | 50 | 45 | Out of Invention |
| 10 | EM-5 | $6.5 \times 10^{-8}$ | 0.19 | 55 | 70 | 60 | Out of Invention |
| 11 | EM-1 | — | 0.22 | 75 | 100 | 85 | Out of Invention* |
| 12 | EM-2 | — | 0.18 | 130 | 140 | 145 | Invention* |
| 13 | EM-3 | — | 0.18 | 205 | 230 | 215 | Invention* |
| 14 | EM-4 | — | 0.17 | 140 | 160 | 150 | Invention* |
| 15 | EM-5 | — | 0.24 | 70 | 80 | 70 | Out of Invention |
| 16 | EM-6 | — | 0.22 | 45 | 55 | 50 | Out of Invention |
| 17 | EM-1 | $6.5 \times 10^{-6}$ | 0.18 | 130 | 155 | 140 | Invention* |
| 18 | EM-1 | $6.5 \times 10^{-8}$ | 0.19 | 190 | 220 | 205 | Invention* |
| 19 | EM-5 | $6.5 \times 10^{-6}$ | 0.22 | 45 | 60 | 50 | Out of Invention |
| 20 | EM-5 | $6.5 \times 10^{-8}$ | 0.22 | 55 | 65 | 60 | Out of Invention |

*Fine grains of AgI were present during growing emulsion grains.

In Table-4, the sensitivities are shown in such a manner that, taking the reciprocal number of the exposure required to give a density of fog +0.1 in each of the cases where the couplers were added and not added, the sensitivies of Samples No. 1 through No. 10 are each indicated by a value relative to the sensitivity of Sample No. 1, which is set at a value of 100, obtained by exposing it to light for 1/12.5 seconds and the sensitivies of Samples No. 11 through No. 20 are each indicated by a value relative to the sensitivity of Sample No. 11, which is set at a value of 100, obtained by exposing it to light for 1/12.5 seconds.

As shown in Table-4, in the samples each not containing any coupler, among Samples No. 1 through No. 10, Samples No. 2 through No. 4 of the invention each using the grain doped with iridium inside the crystals thereof were proved to be lower in fog and higher in sensitivity than Comparative Samples No. 1 and No. 5 each not doped with any iridium inside the crystals thereof. Further, as is obvious from the results from Samples No. 7 through No. 10, Inventive Samples No. 7 and No. 8 to each of which iridium was added after the crystals thereof were completely grown up were proved to be lower in fog and higher in sensitivity than Sample No. 1 and Comparative Samples No. 9 and No. 10 to each of which iridium was added after the crystals thereof were completely grown up, and they were also proved to be able to obtain the same effects as in the case that iridium was doped inside the crystals.

When an illuminance is either low or high, the samples using the emulsions of the invention are higher in sensitivity than any Comparative Sample. It can be understood that the invention can be effectual in improving an illuminance reciprocity law failure.

Samples No. 11 through No. 20 to each of which couplers were added can display the same effects as in the case where no coupler was added. It was proved that the samples of the invention are low in fogginess and high in sensitivity.

EXAMPLE 2

Samples No. 21 through No. 26 were prepared in the manner that the emulsions EM-7 through EM-12 each described in Manufacturing Examples 3 and 4 were each subjected to the chemical and spectral sensitization in the same way as in Example 1 and magenta couplers were then added thereto as shown in Table-5, provided, as for the spectral sensitization, the following sensitizing dyes (III) and (IV) were used in the amounts of 300 mg and 30 mg per tool of AgI, respectively.

Each of the resulting Samples No. 21 through No. 26 was exposed to light and then processed in the same procedures as in Example 1, provided, the exposure were made for 1/12.5 seconds through a blue or yellow filter and were then treated in Processing Steps (II) given in Example 1.

Sensitizing dye (III)

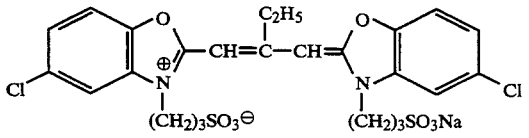

Sensitizing dye (IV)

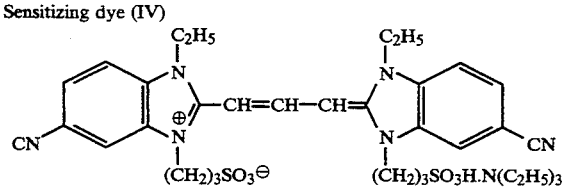

The results thereof as shown in Table-5. Wherein, each resulting sensitivity is represented by the reciprocal number of an exposure required to give a density of fog +0.1, the resulting blue sensitivity is represented by a value relative to the blue sensitivity value set at a value of 100 of Sample No. 21 not yet added thereto any spectral sensitizing dye, and the resulting minus-blue sensitivity is represented by a value relative to the minus-blue sensitivity set at a value of 100 of Sample No. 21.

TABLE 5

| Sample No. | Emulsion | Dmin | Before spectrally sensitized to blue | After spectrally sensitized to blue | After spectrally sensitized to yellow | Subject to Invention or out of Invention |
|---|---|---|---|---|---|---|
| 21 | EM-7 | 0.26 | 100 | 70 | 110 | Out of Invention |
| 22 | EM-8 | 0.24 | 170 | 160 | 265 | Invention* |
| 23 | EM-9 | 0.26 | 90 | 60 | 95 | Out of Invention |
| 24 | EM-10 | 0.25 | 75 | 50 | 85 | " |
| 25 | EM-11 | 0.30 | 60 | 30 | 65 | " |
| 26 | EM-12 | 0.30 | 65 | 35 | 70 | " |

*Fine grains of AgI were present during growing emulsion grains.

As shown in Table-5, it can be understood that Sample No. 22 of the invention which used the emulsion grain doped therein with iridium inside the crystals thereof is characterized in that a decrease in the intrinsic sensitivity by dyes is less extent than that in Comparative Samples and that not only the sensitivity is higher in the spectrally sensitized regions but the fog is lower.

It is further understood from Samples No. 25 and No. 26 that the silver iodobromide emulsion grains having a uniform halide compositions can little display the effect of the invention that is contributed by an iridium compound.

The effects of the invention could be obtained as in Sample No. 22, even when making use of either emulsion grains doped uniformly therein with iridium or the other emulsion added thereto with iridium at a time before 98.5% of the whole silver amount was added, under the same grain growing conditions as in EM-8.

EXAMPLE 3

A multilayered color light-sensitive material No. 27 was so prepared as to be coated over a subbed cellulose acetate support and to comprise the layers having the following corresponding compositions.

In the following compositions, the amounts of silver halide and colloidal silver each coated are expressed in terms of the g/m$^2$ unit of silver contained therein; the amounts of additives and gelatin each used are expressed in terms of the g/m$^2$ unit thereof; and the amounts of sensitizing dyes and couplers each used are expressed in terms of the tool numbers thereof in one and the same layer per mol of silver halides used.

The emulsions contained in every color-sensitive emulsion layer were further subjected to the optimum sensitization in the same way as in Example 1.

| Layer | Principle Composition | Amount Used |
|---|---|---|
| Layer 1, HC, an antihalation layer | Black colloidal silver | 0.20 |
| | Gelatin | 1.5 |
| | UV abdorbent, UV-1 | 0.1 |
| | UV absorbent, UV-2 | 0.2 |
| | Dioctyl phthalate, DOP | 0.03 |
| Layer 2, IL-1, an interlayer | Gelatin | 2.0 |
| | 2,5-di-t-octyl hydroquinone, AS-1 | 0.1 |
| | DOP | 0.1 |
| Layer 3, R-1, the 1st red-sensitive emulsion layer | EM-1 | 1.2 |
| | Gelatin | 1.1 |
| | Sensitizing dye 5 | $6 \times 10^{-4}$ |
| | Sensitizing dye 6 | $1 \times 10^{-4}$ |
| | Coupler $C_1$-1 | 0.06 |
| | Coupler CC-1 | 0.003 |
| | DOP | 0.6 |
| Layer 4, R-2, the 2nd red-sensitive emulsion layer | EM-7 | 1.0 |
| | Gelatin | 1.1 |
| | Sensitizing dye 5 | $3 \times 10$ |
| | Sensitizing dye 6 | $1 \times 10^{-4}$ |
| | Coupler $C_1$-1 | 0.03 |
| | DOP | 0.2 |
| Layer 5, IL-2, an interlayer | Gelatin | 0.8 |
| | AS-1 | 0.03 |
| | DOP | 0.1 |
| Layer 6, G-1, the 1st green-sensitive emulsion layer | EM-1 | 1.1 |
| | Gelatin | 1.2 |
| | Sensitizing dye 1 | $2.5 \times 10^{-4}$ |
| | Sensitizing dye 2 | $1.2 \times 10^{-4}$ |
| | Coupler $M_1$-1 | 0.045 |
| | Coupler CM-1 | 0.009 |
| | Tricresyl phosphate, TCP | 0.5 |
| Layer 7, G-2, the 2nd green-sensitive emulsion layer | EM-7 | 1.3 |
| | Gelatin | 0.8 |
| | Sensitizing dye 3 | $1.5 \times 10^{-4}$ |
| | Sensitizing dye 4 | $1.0 \times 10^{-4}$ |
| | Coupler $M_1$-1 | 0.03 |
| | TCP | 0.3 |
| Layer 8, YC, a yellow filter layer | Gelatin | 0.6 |
| | Yellow colloidal silver | 0.08 |
| | AS-1 | 0.1 |
| | DOP | 0.3 |
| Layer 9, B-1, the 1st blue-sensitive emulsion layer | EM-1 | 0.5 |
| | Gelatin | 1.1 |
| | Sensitizing dye 7 | $1.3 \times 10^{-4}$ |
| | Coupler $Y_1$-1 | 0.29 |
| | TCP | 0.2 |
| Layer 10, B-2, the 2nd blue-sensitive emulsion layer | EM-7 | 0.7 |
| | Gelatin | 1.2 |
| | Sensitizing dye 7 | $1 \times 10^{-4}$ |
| | Coupler $Y_1$-1 | 0.08 |
| | TCP | 0.1 |
| Layer 11, Pro-1, the 1st protective layer | Gelatin | 0.55 |
| | UV absorbent, UV-1 | 0.1 |
| | UV absorbent, UV-2 | 0.2 |
| | DOP | 0.03 |
| | Silver iodobromide having an AgI content of 1 mol % and an average grain-size of 0.07 μm | 0.5 |
| Layer 12, Pro-2, a protective layer | Gelatin | 0.5 |
| | Polymethyl methacrylate grains having a grain-diameter of 1.5 μm | 0.2 |
| | Formalin scavenger, HS-1 | 3.0 |
| | Layer hardener, H-1 | 0.4 |

Besides the above compositions, surfactants were added into each of the layers so as to serve as the coating aids.

Sensitizing dye 1

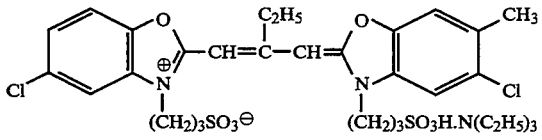

Sensitizing dye 2

-continued
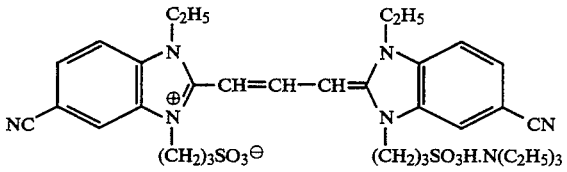
Sensitizing dye 3
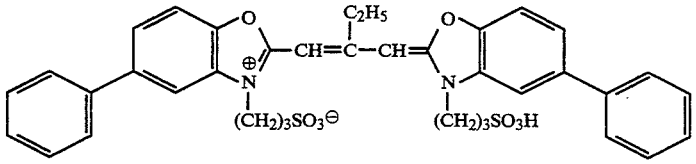
Sensitizing dye 4
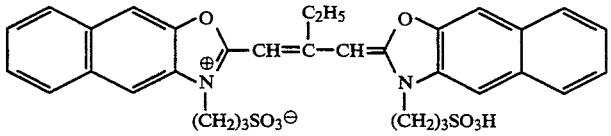
Sensitizing dye 5
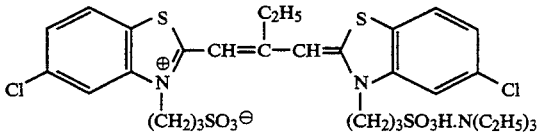
Sensitizing dye 6
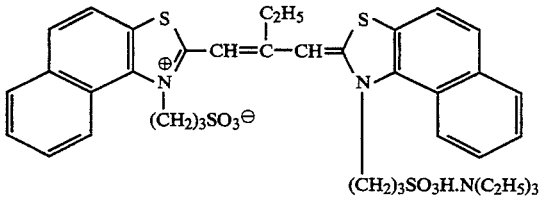
Sensitizing dye 7
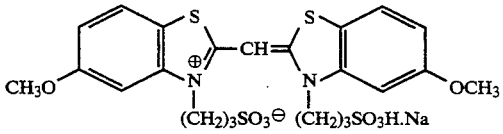
$C_1$-1
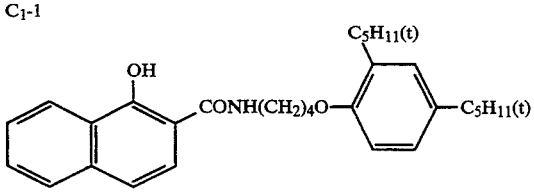
$M_1$-1
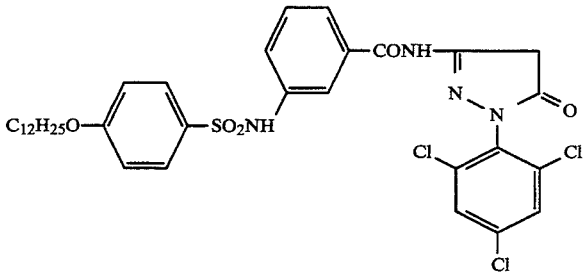
$Y_1$-1

-continued
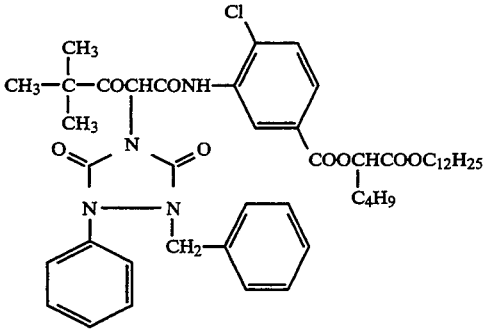
CC-1
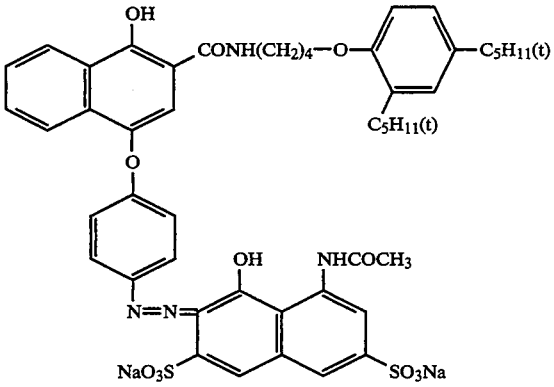
CM-1
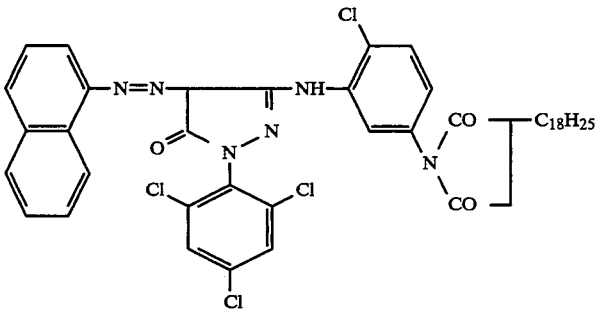
UV-1
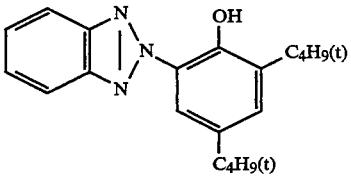
UV-2
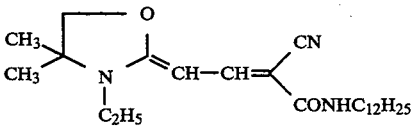
HS-1
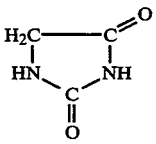
H-1

-continued

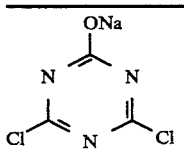

AS-1

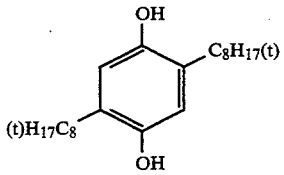

Further, Samples No. 28 through No. 30 were prepared in the following procedures:

Sample No. 28 was a sample prepared in quite the same manner as in Sample No. 27, except that EM-1 and EM-7 of Sample No. 27 were replaced by EM-3 and EM-8, respectively.

Sample No. 29 was a sample prepared in quite the same manner as in Sample No. 27, except that EM-1 and EM-7 of Sample No. 27 were replaced by EM-5 and EM-9, respectively.

Sample No. 30 was a sample prepared in quite the same manner as in Sample No. 27, except that EM-1 and EM-7 of Sample No. 27 were replaced by EM-6 and EM-10, respectively.

Each of the resulting samples was exposed to white light and was then processed. After then, each of the relative sensitivities thereof was measured.

The relative sensitivities were measured of the cyan, magenta and cyan densities in the ordinary method, respectively. The results thereof are shown in Table-6 .

TABLE 6

| No. | B | G | | R |
|---|---|---|---|---|
| 27 | 100 | 100 | 100 | (comparative) |
| 28 | 220 | 190 | 150 | (inventive) |
| 29 | 70 | 75 | 80 | (comparative) |
| 30 | 55 | 65 | 70 | (comparative) |

In the table,
B: Blue-sensitivity,
G: Green-sensitivity, and
R: Red-sensitivity

The sensitivities of B, G and R are indicated each by a value relative to the sensitivity value set at a value of 100 of Sample No. 27.

As is obvious from Table-6, it was proved that Sample No. 28 used therein the silver halide emulsions relating to the invention are higher in sensitivity than in Comparative Samples No. 27, No. 29 and No. 30 and that the multilayered samples are also able to display the same effects as in the single-layered samples.

What is claimed is:

1. A method of preparing a silver halide emulsion containing core/shell silver halide grains comprising two or more phases having different silver halide compositions, a core portion containing silver iodide in an amount of 15 to 40 mol %, said method comprising;

preparing seed grains, introducing a water-soluble halide and a water-soluble silver salt to initiate grain growth to form silver halide on said seed grains, said growth being conducted in the presence of fine grains of silver iodide having an average grain size of 0.01 to 0.1 μm, and introducing a water-soluble iridium salt after at least 70% of the ultimate grain size of said silver halide grains is reached.

2. The method of claim 1, wherein said core/shell grains are subjected to a chemical ripening treatment.

3. The method of claim 2, wherein said iridium ions are added at a time prior to a chemical ripening treatment.

4. The method of claim 1, wherein said iridium ions are added in an amount of not more than $1\times10^{-5}$ mols per mol of silver halide.

5. The method of claim 4, wherein said iridium ions are added in an amount of not more than $1\times10^{-7}$ mols per mol of silver halide.

6. A silver halide photographic light-sensitive material comprising a silver halide emulsion layer containing core/shell silver halide grains comprising two or more phases having different silver halide compositions, a core portion containing silver iodide in an amount of 15 to 40 mol %, said silver halide grains being grown by:

preparing seed grains, introducing a water-soluble halide and a water-soluble silver salt to initiate grain growth to form silver halide on said seed grains, said grain growth being carried out in the presence of fine grains of silver iodide having an average grain size of 0.01 to 0.1 μm, and introducing a water-soluble iridium salt after at least 70% of the ultimate grain size of said silver halide grains is reached.

7. The material of claim 6 wherein said core/shell grains are subjected to a chemical ripening treatment.

8. The material of claim 7 wherein said iridium ions are added prior to said chemical ripening treatment.

9. The material of claim 6 wherein said iridium ions are added in an amount of not more than $1\times10^{-5}$ mols per mol of silver halide.

10. The material of claim 9 wherein said iridium ions are added in an amount of not more than $1\times10^{-7}$ mols per mol of silver halide.

* * * * *